US008005388B2

(12) United States Patent
Maul et al.

(10) Patent No.: US 8,005,388 B2
(45) Date of Patent: Aug. 23, 2011

(54) MEDIA VELOCITY, MEDIA PRESENT AND BUBBLE CONTROL IN AN ELECTROPHOTOGRAPHIC PROCESS

(75) Inventors: Michael David Maul, Lexington, KY (US); James Douglas Gilmore, Lexington, KY (US); Jennifer Sauer, Goshen, KY (US)

(73) Assignee: Lexmark International, Inc., Lexington, KY (US)

( * ) Notice: Subject to any disclaimer, the term of this patent is extended or adjusted under 35 U.S.C. 154(b) by 1176 days.

(21) Appl. No.: 11/553,204

(22) Filed: Oct. 26, 2006

(65) Prior Publication Data

US 2008/0101813 A1 May 1, 2008

(51) Int. Cl.
*G03G 15/20* (2006.01)

(52) U.S. Cl. ..... 399/68; 399/361

(58) Field of Classification Search ..... 399/68, 399/361, 16, 67

See application file for complete search history.

(56) References Cited

U.S. PATENT DOCUMENTS

| | | | | |
|---|---|---|---|---|
| 4,928,141 | A * | 5/1990 | Poehlein et al. | 399/68 |
| 5,915,691 | A * | 6/1999 | Deguchi et al. | 271/265.01 |
| 2002/0141773 | A1* | 10/2002 | Nakamura | 399/68 |
| 2003/0035671 | A1* | 2/2003 | Estabrooks | 399/385 |
| 2003/0156853 | A1* | 8/2003 | Fukutani | 399/68 |
| 2005/0254847 | A1* | 11/2005 | Kietzman et al. | 399/68 |
| 2008/0075477 | A1* | 3/2008 | Kiely et al. | 399/16 |
| 2010/0295241 | A1* | 11/2010 | Isogai | 271/227 |
| 2010/0329718 | A1* | 12/2010 | Isohara et al. | 399/68 |

FOREIGN PATENT DOCUMENTS

JP 08146683 A * 6/1996

* cited by examiner

*Primary Examiner* — David M Gray
*Assistant Examiner* — Geoffrey T Evans

(57) ABSTRACT

In an image forming device, the actual speed of a media sheet through a fuser is detected and the fuser speed is controlled so as to maintain a bubble in the media sheet within predetermined limits. A media sheet speed sensor is disposed downstream of the fuser nip. The sensor may be a rotary optical encoder generating a signal comprising a series of pulses, the spacing of the pulses indicative of the speed of at least the leading edge of a media sheet actuating the sensor. Based on the actual speed of the media sheet, the speed of the fuser is adjusted to maintain a desired bubble in the media sheet, when the media sheet is engaged by both the fuser nip and another nip in the media path, such as a toner transfer nip.

17 Claims, 4 Drawing Sheets

MEDIA VELOCITY, MEDIA PRESENT AND BUBBLE CONTROL IN AN ELECTROPHOTOGRAPHIC PROCESS

BACKGROUND

The present application relates generally to electrophotographic image forming devices, and in particularly to controlling the speed of a media sheet through a fuser so as to control the size of a bubble in the media sheet between a toner transfer station and the fuser Electrophotographic image forming devices, such as printers, copiers, fax machines, and combinations of these functions (known as all-in-one devices), are a ubiquitous accessory in the office/computing environment. High throughput (i.e., the number of pages printed per minute, or ppm), high image quality, and compact size (i.e., a small desktop "footprint") are desirable features of electrophotographic image forming devices.

Media sheets, such as paper, transparencies, envelopes, and the like, move along a media path through an electrophotographic image forming device. The media path includes a toner transfer area where toner images are transferred to the media sheets. The toner material comprises fine particles of plastic of particular colors. A media sheet with toner images formed on it then passes through a fuser where heat and pressure are applied to melt the toner and adhere it to the media sheet, permanently fixing the image on the sheet.

A controller may monitor and control the movement of media sheets along the media path. The controller may carefully control the speed of the media sheet at various points to ensure adequate print quality. One area where the speed is carefully controlled is the toner transfer area where the media sheet should move within a specific speed range. If the media sheet moves too quickly or slowly through this area, the toner images are not adequately transferred to the media sheet, which may result in a print defect. The speed of a media sheet through the fuser may also be controlled, to optimally fix the toner to the media sheet.

The media sheet may move at different speeds along different sections of the media path. In particular, the media sheet may move at a different speed through the fuser than it moves through the toner transfer area. In compact electrophotographic image forming devices, the distance along the media path from the toner transfer area to the fuser may be less than the length of a typical media sheet. In this case, a media sheet may be present in both the fuser nip and the toner transfer nip at the same time.

If the fuser nip is driven faster and with a higher nip pressure than the toner transfer nip, the fuser nip may "drag" the media sheet through the toner transfer nip, causing a print defect. If the fuser nip is driven slower than the toner transfer nip, a bend or "bubble" will form in the media sheet between the toner transfer and fuser nips, The size of the bubble depends on the relative speeds of the two nips. Particularly in compact designs, if the bubble is too large, the media sheet may contact elements outside of the media path, which may disturb the toner image on the media sheet, deposit unwanted toner on the media sheet, or otherwise adversely affect print quality. The lower limit on the size of the bubble is zero, at which point the fuser nip may drag the media sheet through the toner transfer nip, causing a print defect. Accordingly, controlling the bubble size is important to maintain image quality, in compact image forming devices where the distance between the toner transfer area and the fuser along the media path is less than the length of a media sheet.

SUMMARY

The present application is directed to detecting the actual speed of a media sheet at a fuser in an electrophotographic image forming device, and controlling the fuser speed so as to maintain a bubble in the media sheet within predetermined limits. A media sheet speed sensor is disposed downstream of the fuser nip. The sensor may be a rotary optical encoder generating a signal comprising a series of pulses, the spacing of the pulses indicative of the speed of at least the leading edge of a media sheet actuating the sensor. Based on the actual speed of the media sheet, the speed of the fuser is adjusted to maintain a desired bubble in the media sheet.

DETAILED DESCRIPTION

The present application is directed to controlling the speed of a media sheet through the fuser of an electrophotographic image forming device, so as to control the size of a bubble between the fuser and an upstream toner transfer area. A sensor associated with the fuser and disposed in the media path detects the position and speed of at least the leading edge of a media sheet. A controller then adjusts the speed of the fuser in response to the sensor to control the fuser speed relative to the toner transfer nip speed, thus controlling the bubble size.

Figure 1:
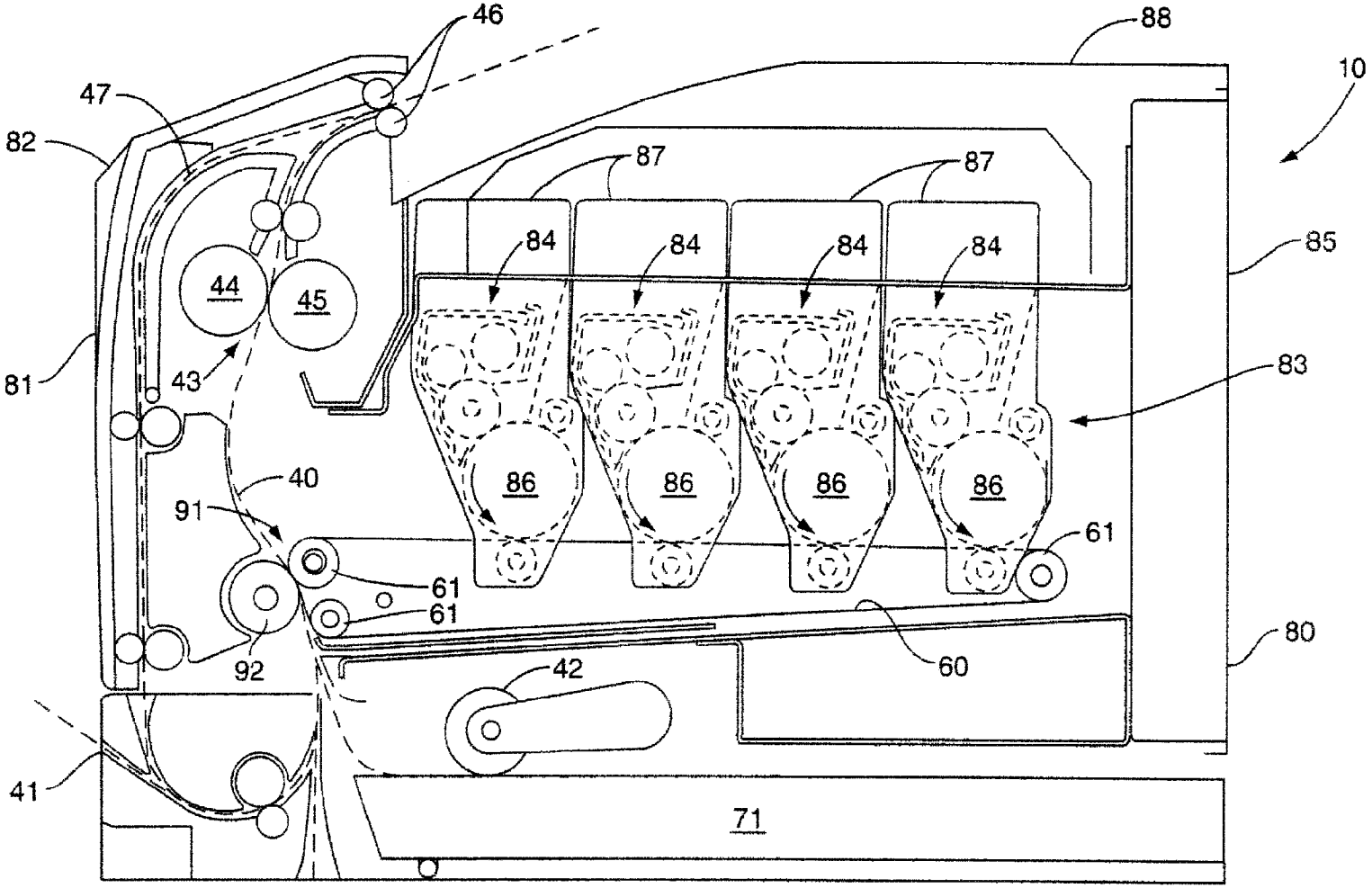
FIG. 1 is schematic side view of an image forming device according to one embodiment.

FIG. 1 depicts a representative electrophotographic image forming device 10, which may comprise a laser printer (either mono or color), facsimile, copier, or all-in-one device combining these functions. The device 10 may be sized to fit on a workspace, such as a desktop. The device 10 may further include accessible work areas for the user to insert and remove media sheets, replace components within the device, and clear media jams from within the device.

The device 10 includes a media input tray 71 positioned in a lower section of a body 80. The tray 71 is sized to contain a stack of media sheets that will receive color and/or monochrome images. The media input tray 71 is preferably removable for refilling. Therefore, in this embodiment, a user may insert and remove the media input tray 71 from the device 10 through a front 81 of the body 80. A control panel 82 may be located on the front 81 of the body 80. Using the control panel 82, the user is able to enter commands and generally control the operation of the image-foring device 10. For example, the user may enter commands to switch modes (e.g., color mode, monochrome mode), view the number of images printed, take the device 10 on/off line to perform periodic maintenance and the like.

A first toner transfer area 83 includes one or more imaging units 84 that are aligned horizontally extending from the front 81 to a back 85 of the body 80. Each imaging unit 84 includes a charging roll, a developer roll and a rotating photoconductive (PC) drum 86. The charging roll forms a nip with the PC drum 86 and charges the surface of the PC drum 86 to a specified voltage, such as −1000 volts, for example. A laser beam from a printhead contacts the surface of the PC drum 86 and selectively optically discharges particular areas to form a latent image. In one embodiment, areas on the PC drum 86 illuminated by the laser beam are discharged to approximately −300 volts. The developer roll, which also forms a nip with the PC drum 86, then develops the latent image by transferring toner particles from a toner reservoir 87 to the PC drum 86. The toner particles are electrostatically attracted to the areas of the PC drum 86 surface discharged by the laser beam, and are not attracted to areas of the PC drum 86 surface that were not discharged by the laser beam. In one embodiment the toner reservoirs 87 each contain one of black magenta, cyan, or yellow toner.

An intermediate transfer mechanism (ITM) 60 is disposed adjacent to each of the imaging units 84. In this embodiment the ITM 60 is formed as an endless belt disposed around support rollers 61. The ITM 60 may be constructed from a variety of materials including polyimide, Ethylene TetrafluoroEthylene (ETFE), nylon, thermoplastic elastomers (TPE), polyamide-imid, and polycarbonate alloy. During image forming operations, the ITM 60 moves past the imaging units 84 in a clockwise direction as viewed in FIG. 1. One or more of the PC drums 86 apply toner images in their respective colors to the ITM 60. In one embodiment, a positive voltage field attracts the toner image from the PC drums 86 to the surface of the moving ITM 60.

Figure 2:
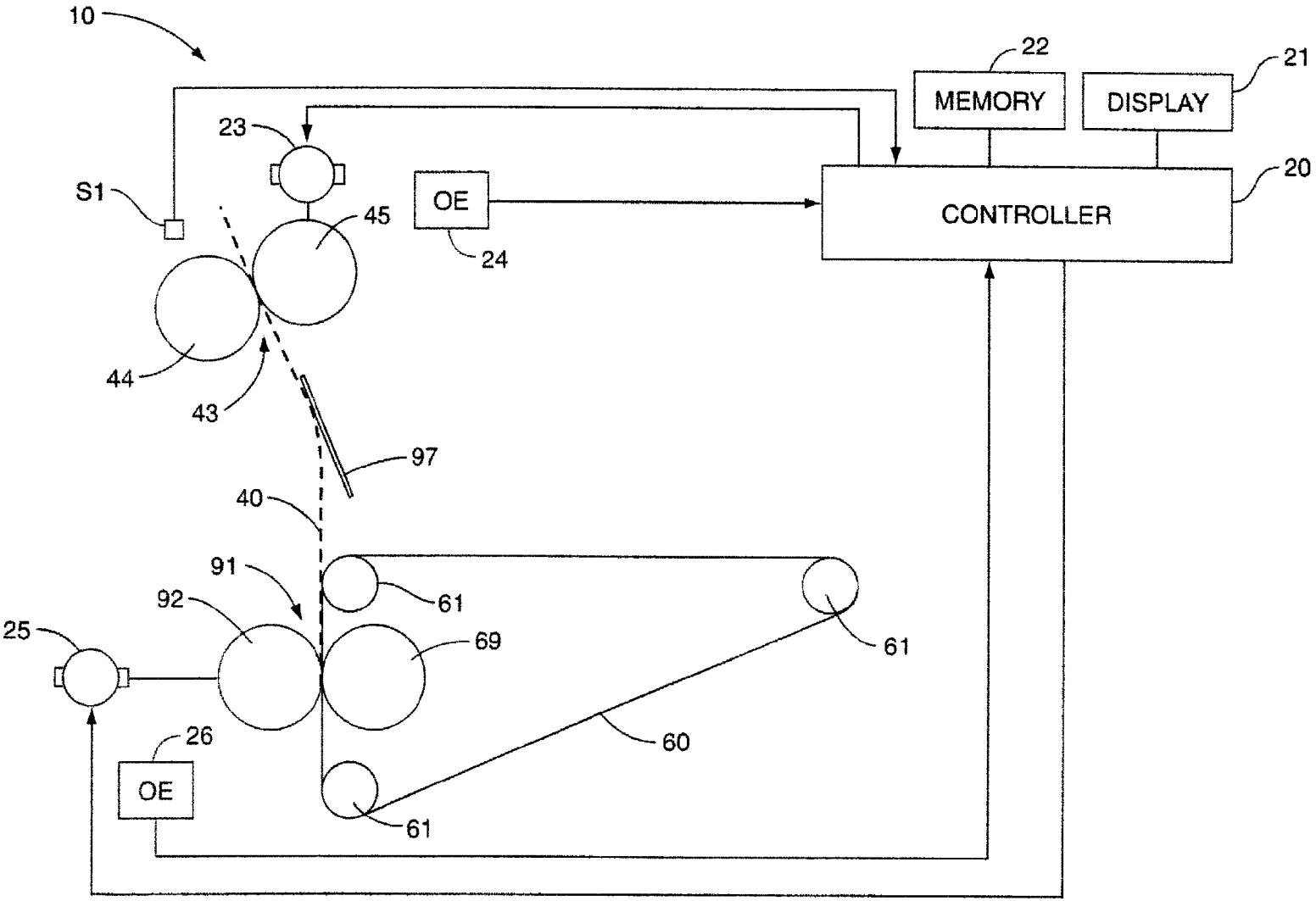
FIG. 2 is schematic view of a controller within an image forming device according to one embodiment.

The ITM 60 rotates and collects the one or more toner images from the imaging units 84 and then conveys the toner images to a media sheet at a second transfer area. The second transfer area includes a toner transfer nip 91 formed between one of the rollers 61 and a second transfer roller 92. In other embodiments as illustrated in FIG. 2, the toner transfer nip 91 is formed between roller 92 and a separate back-up roller 69.

A media path 40 extends through the device 10 for moving the media sheets. Media sheets are initially stored in the input tray 71 or introduced into the body 80 through a manual feed 41. The sheets in the input tray 71 are picked by a pick mechanism 42 and moved into the media path 40. In this embodiment, the pick mechanism 42 includes a roller positioned at the end of a pivoting arm, The roller rotates to move the media sheets from input tray 71 towards the second transfer area. In one embodiment, the pick mechanism 42 is positioned to move the media sheets directly from the input tray 71 into the toner transfer nip 91. For sheets entering through the manual feed 41, one or more rollers are positioned to move the sheet into the toner transfer nip 91.

The media sheet receives the toner image from the ITM 60 as it moves through the toner transfer nip 91. The sheets with toner images then move along the media path 40 and into a fuser nip 43. Fuser nip 43 is formed between a pair of rollers 44, 45, or a belt 44 and roller 45. The belt or roller 44 includes a heat source, and the roller 45 is pressed against the belt or roller 44 to create a nip pressure. The fuser nip 43 thus applies heat and pressure to adhere the toner images to the media sheet.

The fused media sheet then pass through exit rollers 46 that are located downstream from the fuser nip 43. Exit rollers 46 may be rotated in either forward or reverse directions. In a forward direction, the exit rollers 46 move the media sheet from the media path 40 to an output area. In a reverse direction, the exit rollers 46 move the media sheet into a duplex path 47 for image formation on a second side of the media sheet.

The toner transfer nip 91 and fuser nip 43 each function to move the media sheet along sections of the media path 40, in addition to their respective toner transfer and fusing functions. Therefore, the speeds of the nips 91, 43 are controlled to maintain the proper speed to ensure toner transfer at the toner transfer nip 91 and adequate fusing at the fuser nip 43.

FIG. 2 illustrates a schematic view of the image forming device 10 that includes a controller 20. Controller 20 oversees the timing and movement of the toner images and the media sheets. In one embodiment as illustrated in FIG. 2, controller 20 includes a microprocessor with associated memory 22. In various embodiments, controller 20 may include a microprocessor, DSP, microcontroller, Finite State Machine, or the like; RAM, ROM, PROM, EEPROM, Flash, or other memory 22; and an input/output interface. A display 21 may further be operatively connected to the controller 20 for displaying messages to an operator. The display 21 may include an LED or LCD array to display alpha-numeric characters.

The controller 20 may control the speed of the toner transfer nip 91 by monitoring a shaft encoder 26 and sending control signals to a motor 25 that drives one or both rollers 92, 69. The encoder 26 is mechanically connected to the shaft of the motor 25—either directly or via a drive train—and is operatively connected to the controller 20. The encoder 26 sends signals to the controller 20 from which rotational speed and position of the motor 25 is derived. Similarly, the controller 20 is operatively connected to a motor 23 and encoder 24 at the fuser area 43. The motor 23 drives one or both rollers or belts 44, 45 as the media sheets move through the fuser area 43 and to the discharge rollers 46. The controller 20 is programmed to control the relative speeds of the toner transfer nip 91 and the fuser nip 43 to maintain a bubble in a media sheet within predetermined limits.

However, the speed of the media sheet through the fuser nip 43 may vary in use due to environmental factors. The fusing belt or roller 44 and the roller 45 are typically coated with a compliant material to increase the size of the fusing region as well as aid in the release of the media and toner from the roller or belt 44 and the roller 45. However, as heat is generated inside the fusing member 44 to melt the toner, these compliant materials may expand and change the functional velocity of the media, even if the rollers/belt 44, 45 are driven at a constant speed In addition to the thermal expansion of the fusing components, belt fusing technologies often have variations in velocity due to changes in the lubricant velocity and friction as the temperature changes. This can lead to changes in the belt velocity in the system, and large velocity variations which cannot be accounted for by monitoring the speed of the motor 23 via the encoder 24.

Accordingly, a sensor S1, disposed at the output of the fuser nip 43 and operatively connected to the controller 20, senses the speed of at least the leading edge of a media sheet. The controller 20 utilizes this measurement of the actual speed of the media sheet to control the speed of the fuser nip 43 to maintain a desired media sheet bubble between the fuser nip 43 and the toner transfer nip 91.

Figure 3:
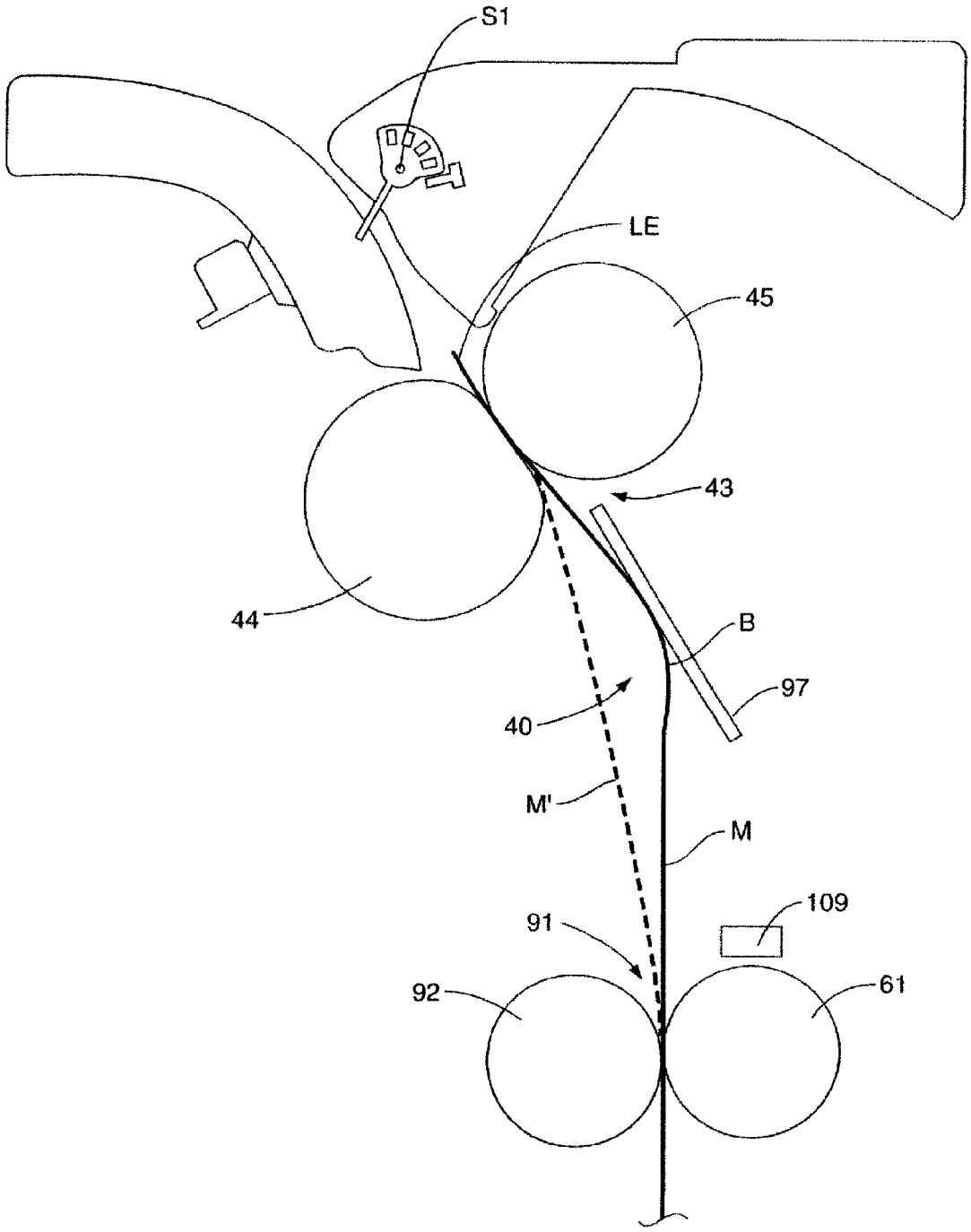
FIGS. 3 and 4 are schematic views of a media sheet moving along a media path according to two embodiments.

FIG. 3 depicts a media sheet M moving simultaneously through the toner transfer nip 91 and the fuser nip 43. The nip 91 is controlled to move the media sheet M at the proper speed to ensure good toner transfer from the ITM 60 (not shown). The nip 91 also moves the leading edge LE of the media sheet into a bumper 97 that further directs the leading edge LE towards the fusing nip 43. The speed of the fuser nip 43 is controlled to maintain an appropriately sized bubble B in the media sheet M. For comparison, an alternative media sheet M', depicted in FIG. 3 as a dashed line, follows a path resulting from the user nip 43 turning faster than the toner transfer nip 91 and eliminating the bubble B. The media sheet M' may be dragged by the fuser nip 43 through the toner transfer nip 91, resulting in print defects. On the other hand, an excessive bubble B may cause the media sheet M to contact a cleaner unit 109 that removes waste toner from the ITM 60. This contact may inadvertently transfer waste toner to the media sheet M. Accordingly, control of the actual speed of the media sheet M through the user nip 43, relative to the speed of the toner transfer nip 91, is critical to maintain the bubble B within a size range that avoids print defects, waste toner transfer, and other deleterious effects.

FIG. 3 depicts one embodiment of the sensor S1 that detects the speed of the leading edge LE of the media sheet M leaving the fuser nip 43. A flag extends into the media path 40, and is deflected by the leading edge LE of the media sheet M. A series of windows are positioned radially in an arc opposite a pivot point of the sensor S1 from the flag. Disposed on opposite sides of the sensor S1, in radial alignment with the windows, are an optical source, such as an LED, and an optical detector, such as a phototransistor or photodiode coupled to appropriate thresholding circuitry. As the sensor S1 pivots due to the deflection of the flag by the leading edge LE of a media sheet M, the windows successively pass between the optical source and sensor, generating an output signal comprising a series of pulses. The controller 20 may derive the speed of the leading edge LE of the media sheet M from the spacing of the pulses.

In this embodiment, the speed of the media sheet M is assumed to be constant, such that the measured speed of the leading edge LE is taken as the speed of the entire media sheet M Once the media sheet M exits the fuser nip 43 and passes the sensor S1, the sensor S1 flag again falls over the media path of 40, either by gravity or under the influence of a spring, and is ready to measure the actual speed of the next media sheet M.

The embodiment of the sensor S1 depicted in FIG. 3 is well suited for relatively low speed, low cost, image forming devices, due to the limited data produced. Depending on the flag size, the sensor S1 is limited to a small number of windows (e.g., two to four) that may be used to determine the speed of the media sheet M. Increasing the number of windows to obtain a greater accuracy requires that the size of each window be reduced, thus increasing the sampling rate required to obtain sufficient resolution to accurately determine the speed of the media sheet M. Since relatively few samples are taken, and these samples are taken only at the leading edge LE of the media sheet M, the paper path 40 must be robust enough that the leading edge LE is always well controlled to minimize the sensor error Accordingly, this embodiment is best suited to provide a rough estimate of the speed of a media sheet M, which is sufficient for image forming devices that have large bubble tolerances. As one non-limiting example, in testing at process speeds up to 20 ppm, a tolerance of +/−4% on the speed measurements was obtained, on a Lexmark C750 platform with a sensor S1 including four windows having 2 mm spacing.

Figure 4:
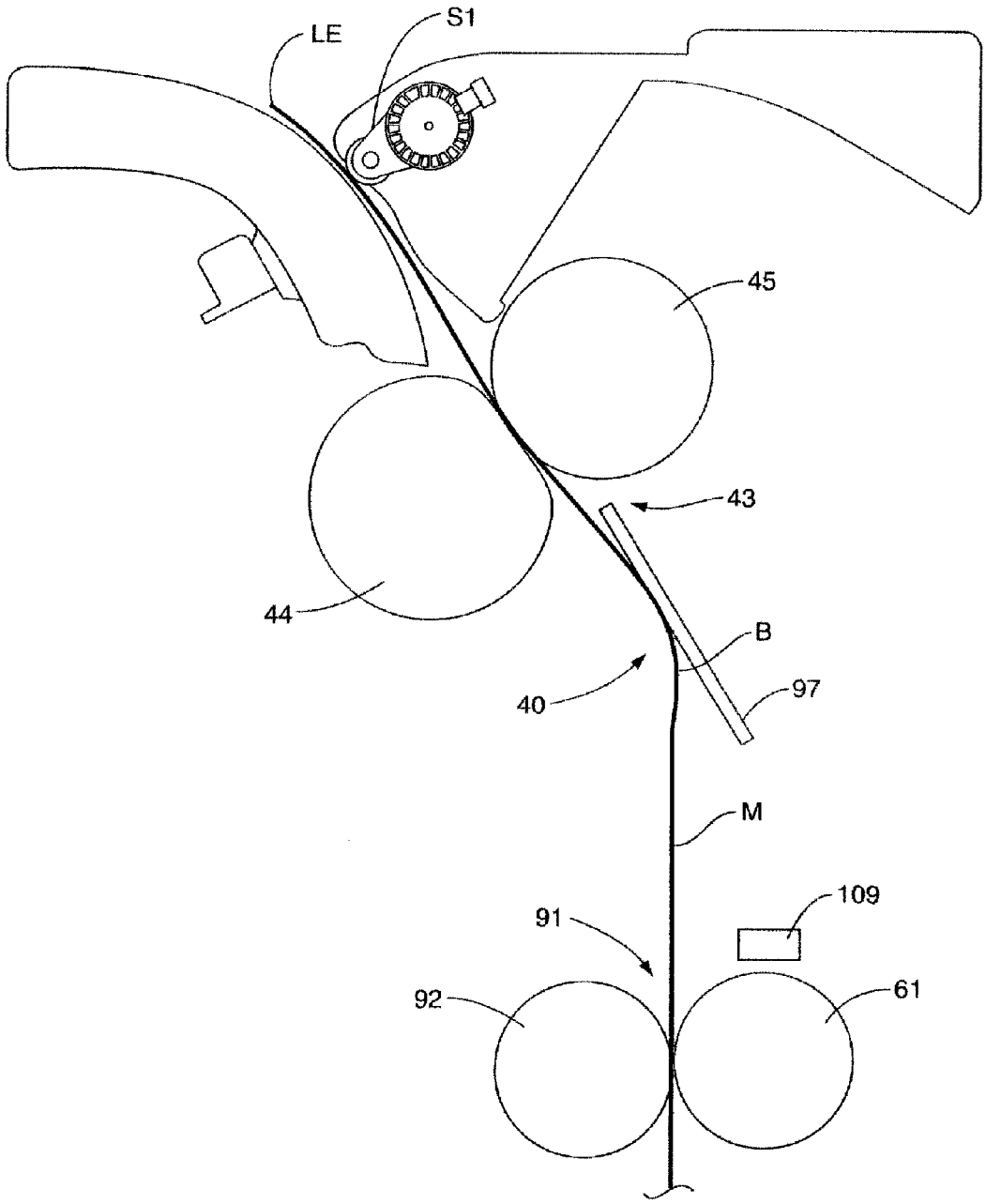

FIG. 4 depicts another embodiment of the sensor S1 that detects the speed of a media sheet M along its entire length, as the media sheet M leaves the fuser nip 43. The sensor S1 includes a wheel having a low rate of thermal expansion. The wheel extends into the media path 40 and contacts the media sheet M. The media sheet M turns the wheel via friction as the media sheet M exits the fuser nip 43. The wheel is coupled by a drive train to an encoding disk containing a plurality of radially spaced windows along the periphery thereof. Similar to the optical encoders 24, 26, an optical source and detector generate a signal comprising a pulse train, which is used by the controller 20 to derive the speed of the media sheet M.

Since the wheel is in contact with the media sheet M along its entire length, a more stable and accurate estimate of the speed of the media sheet M may be obtained, as compared with the embodiment of the sensor S1 depicted in FIG. 3. The increased accuracy is due to speed data being averaged over a predetermined portion of the length of the media sheet M, as opposed to only the first few millimeters thereof.

An additional advantage of the media speed sensor S1 is its use as a "media present" sensor by detecting a transition from zero media velocity to a positive velocity Furthermore, the embodiment of the sensor S1 depicted in FIG. 4 has the ability to detect negative media velocity. Zero or negative media velocity may indicate that a media sheet M is being pulled back into the fusing components due to hot offset or media wraps. By detecting this condition, the controller 20 may immediately shut down the fusing mechanism, preventing damage to other components within the fuser and contamination from the hot toner to the fusing member or guides.

As used herein, the terms "having", "containing", "including", "comprising" and the like are open ended terms that indicate the presence of stated elements or features, but do not preclude additional elements or features The articles "a", "an" and "the" are intended to include the plural as well as the singular, unless the context clearly indicates otherwise. The terms "upstream" and "downstream" refer to relative positions along one or more media paths, with downstream indicating the direction of media sheet travel during a normal image formation process, and upstream indicating the opposite direction. Similarly, the term "first" indicates the upstream-most, and the term "last," indicates the downstream-most, when these terms refer to one or more of a plurality of entities along the media path. As used herein, the velocity of a media sheet along the media path is positive in the downstream direction, and negative in the upstream direction.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming device, comprising:

one or more toner transfer areas operative to transfer toner to a media sheet;

a fuser downstream of a last toner transfer area, the fuser operative to fix the toner to the media sheet;

a media sheet speed sensor downstream of the fuser, the sensor operative to indicate the actual speed of the media sheet through the fuser;

a fuser speed controller operative to adjust the speed of the fuser in response to the media sheet speed sensor;

wherein the media sheet simultaneously traverses at least one toner transfer area and the fuser, and wherein the fuser speed controller is further operative to adjust the speed of the fuser so as to maintain a bubble in the media sheet between the last toner transfer area and the fuser.

2. The device of claim 1 wherein the media sheet speed sensor comprises a rotary encoder and reports at least two rotational positions of the encoder.

3. The device of claim 2 wherein the rotary encoder comprises a plurality of optical windows radially disposed in an arc about a pivoting axis of the encoder.

4. The device of claim 3 wherein the rotary encoder is connected to a flag that is displaced by a leading edge of the media sheet such that the flag displacement imparts rotary motion to the encoder.

5. The device of claim 3 wherein the rotary encoder is a disk, the arc is circular, and the encoder is driven by a wheel contacted and driven by the media sheet.

6. The device of claim 5 wherein the media sheet speed sensor is operative to detect negative velocity of the media sheet.

7. A fuser disposed along a media path in an image forming device, the fuser operative to fix toner to a media sheet, comprising:

a first roller;

a second roller or belt forming a nip with the first roller;

a heat source associated with the second roller or belt and operative to apply heat to a media sheet in the nip;

a media sheet speed sensor disposed downstream of the nip and operative to detect the actual speed of at least a leading edge of the media sheet through the fuser; and a controller operative to alter the speed of the fuser in response to the media sheet speed sensor, so as to maintain a bubble in the media sheet between the fuser and another nip in the media path.

8. The fuser of claim 7 wherein the media sheet speed sensor comprises an optical encoder operative to generate a signal comprising a plurality of pulses, the spacing of the pulses being indicative of the rotational speed of the encoder.

9. The fuser of claim 8 wherein the optical encoder includes a flag disposed in the media path, and is rotated by the leading edge of the media sheet displacing the flag.

10. The fuser of claim 8 wherein the optical encoder comprises a disk driven by a wheel in contact with the media sheet.

11. The fuser of claim 10 wherein the media sheet speed sensor is operative to detect a negative velocity of the media sheet.

12. A method of forming an image on a media sheet, comprising:

transferring toner to the media sheet in one or more toner transfer nips;

simultaneously with transferring toner to at least part of the media sheet, fixing toner to at least part of the media sheet by applying heat and pressure to part of the media sheet in a fuser nip;

determining, downstream of the toner being fixed to the at least part of the media sheet, an actual media sheet speed at the fuser nip; and in response to the actual media sheet speed at the fuser nip, controlling the fuser speed to maintain a bubble in the media sheet, between the last toner transfer nip and the fuser nip.

13. The method of claim 12 wherein determining the actual media sheet speed at the fuser nip comprises calculating the actual media sheet speed based on a signal from a media sheet speed sensor associated with the fuser nip.

14. The method of claim 13 wherein the media sheet speed sensor is downstream of the fuser nip.

15. The method of claim 13 further comprising determining the spacing of pulses in the signal from the media sheet speed sensor, and determining the actual media sheet speed based on the pulse spacing.

16. The method of claim 15 further comprising averaging the pulse spacing over a predetermined portion of the length of the media sheet prior to determining the actual media sheet speed.

17. The method of claim 12 further comprising halting the fuser in response to detecting a negative media sheet velocity.

* * * * *